US008481927B2

(12) United States Patent
Franzen et al.

(10) Patent No.: US 8,481,927 B2
(45) Date of Patent: Jul. 9, 2013

(54) HIGH YIELD ATMOSPHERIC PRESSURE ION SOURCE FOR ION SPECTROMETERS IN VACUUM

(75) Inventors: Jochen Franzen, Bremen (DE); Thorsten Benter, Haan (DE); Hendrik Kersten, Wuppertal (DE); Matthias Lorenz, Wuppertal (DE); Klaus J. Brockmann, Solingen (DE)

(73) Assignee: Bruker Daltonik, GmbH, Bremen (DE)

( * ) Notice: Subject to any disclaimer, the term of this patent is extended or adjusted under 35 U.S.C. 154(b) by 270 days.

(21) Appl. No.: 12/853,637

(22) Filed: Aug. 10, 2010

(65) Prior Publication Data

US 2011/0039350 A1 Feb. 17, 2011

(30) Foreign Application Priority Data

Aug. 17, 2009 (DE) ..... 10 2009 037 716

(51) Int. Cl.
*G21K 5/04* (2006.01)
*H01J 49/26* (2006.01)

(52) U.S. Cl.
USPC ..... 250/288; 250/281; 250/282; 250/423 R; 250/427; 250/423 P; 250/423 F

(58) Field of Classification Search
USPC ..... 250/281, 282, 288, 423 R, 427, 423 P, 250/423 F
See application file for complete search history.

(56) References Cited

U.S. PATENT DOCUMENTS

| | | | | |
|---|---|---|---|---|
| 5,175,431 | A | 12/1992 | Eisele et al. | |
| 6,649,908 | B2 * | 11/2003 | Apffel et al. | 250/288 |
| 2004/0129876 | A1 * | 7/2004 | Franzen | 250/288 |
| 2008/0258052 | A1 * | 10/2008 | Jolliffe et al. | 250/282 |

FOREIGN PATENT DOCUMENTS

GB 2 299 445 A 10/1996

* cited by examiner

*Primary Examiner* — Nicole Ippolito
(74) *Attorney, Agent, or Firm* — Robic, LLP

(57) ABSTRACT

Gaseous analyte molecules are ionized at atmospheric pressure and provided to an inlet capillary of an ion spectrometer vacuum system by passing the ions through a reaction tube that ends in a conical intermediate piece for a gastight and smooth transition into the inlet capillary. The reaction tube is shaped so that the atmospheric pressure gas stream passing therethrough form the entrance of the tune to the intermediate piece is stably laminar. Analyte molecules from gas chromatographs, spray devices or vaporization devices can be introduced into the entrance of the reaction tube and ionized within the tube by single- or multi-photon ionization, by chemical ionization, by reactant ions or by physical ionization. For single- or multi-photon ionization, a beam from a laser can be passed axially down the reaction tube. Reactant ions can be produced by any means outside of the reaction tube and mixed with the analyte molecules within the tube.

16 Claims, 2 Drawing Sheets

HIGH YIELD ATMOSPHERIC PRESSURE ION SOURCE FOR ION SPECTROMETERS IN VACUUM

BACKGROUND

The invention relates to the ionization of gaseous analyte molecules by physical or chemical reactions at atmospheric pressure (API) and the transfer of the analyte ions through an inlet capillary into the vacuum system of an ion spectrometer, for example a mass or a mobility spectrometer. The generation of ions of heavy analyte molecules with molecular weights of a few hundred to many thousand daltons in an electrospray ion source at atmospheric pressure is very well known. The ability to ionize macromolecules, which cannot be vaporized thermally, is extremely important; John Bennett Fenn was awarded with a part of the 2002 Nobel Prize for Chemistry for the development of the electrospray ion source toward the end of the 1980s.

In addition to electrospray ionization (ESI), which is mainly used for proteins and peptides, other types of atmospheric pressure ionization (API) have been developed: atmospheric pressure chemical ionization (APCI), atmospheric pressure photoionization (APPI), and atmospheric pressure laser ionization (APLI).

In the housing of an electrospray ion source, a high voltage of several kilovolts is applied to a pointed spray capillary containing spray liquid with dissolved analyte molecules: an extremely strong electric field is generated around the tip, and this field draws the spray liquid into a fine jet, which quickly disintegrates into minute, highly charged droplets with diameters in the order of a hundred nanometers to a few micrometers. The droplets then evaporate, leaving behind mainly multiply charged ions of the analyte molecules formerly contained in the droplets.

Since the droplets of the spray jet from the spray capillary are all very highly charged, they repel each other very strongly. This causes the spray mist to broaden into a pronounced funnel shape immediately after the droplets have been formed. A spray gas supplied in a sharply focused jet, which can be heated up to around 150° C., can be used to reduce the broadening of the spray mist. When spray gas is used, the analyte ions produced in the very elongated ion formation volume are usually extracted more or less perpendicularly by an electric drawing field and fed to the inlet capillary. This is successful for only a small portion of the analyte ions, however, because only analyte ions from a small section of the length and width of this ion formation volume reach the inlet capillary.

The ion source housing has a volume of around one liter and is somewhat irregularly shaped. Around the inlet capillary, further gas is blown into this ion source housing: the gas to transport the analyte ions through the inlet capillary. In the electrospray ion source housing, confused conditions therefore prevail, with sometimes turbulent gas flows (spray gas, transport gas) and intersecting electric fields (spray voltage, ion extraction voltage). This means it is difficult to guide the analyte ions through the turbulent gas flows to the tiny aperture of the inlet capillary; only very few of the analyte ions formed are actually guided to the inlet capillary.

In an APCI ion source for the chemical ionization of analyte substances at atmospheric pressure, the reactant ions are usually produced by a corona discharge at the tip of a tungsten pin. The reactant ions are usually generated from slightly moist nitrogen; a few nitrogen ions are produced initially, but these quickly react with water molecules and form different types of water complex ions, which can then react with analyte ions by protonation or deprotonation. These processes are known to the person skilled in the art. The analyte molecules are generated from a gas chromatograph or by the thermally assisted spraying of droplets in the spray gas with subsequent evaporation ("thermospray"). Current APCI ion sources are installed in housings which are similar to those of electrospray ion sources, so they can be easily exchanged with these, largely retaining the feed-ins for heated spray and transport gases and the voltage supplies. These housings are mostly unfavorable for introducing the analyte ions into the inlet capillary leading to the ion spectrometer because completely uncontrollable gas flows prevail inside them, including the strong wind produced by the corona discharge, and also largely uncontrollable electric fields caused, for example, by the electric field of the corona discharge and the discharge plasmas produced. Moreover, it is not possible to control how many of the analyte molecules are unintentionally decomposed by the corona discharge plasma.

The situation is similarly confused with current APPI ion sources. The photon impact ionization of these ion sources can act on the analyte molecules themselves, but usually other molecules are ionized by the photon impact, which then react with the analyte molecules in a chemical ionization. The analyte molecules can again originate from gas chromatographs or can be generated by the thermospraying of analyte solutions. The proportions of direct and indirect photoionization can hardly be controlled in a reproducible way. Confused gas flows also prevail in these ion source housings, and transport the analyte ions on sometimes wild trajectories before a very few of them reach the inlet capillary.

A relatively new ionization method is laser ionization at atmospheric pressure (APLI), in which analyte molecules, usually from gas chromatographs, are ionized by multi-photon processes in the beam of the UV light from a suitable pulsed laser. Even if the ionization is performed near the entrance aperture of the inlet capillary, not all analyte ions can be captured.

In an aspirating inlet capillary free-standing in a surrounding gas, a stably laminar flow is formed some distance behind the entrance aperture after some initial boundary turbulence. The boundary turbulence causes a loss of analyte ions. All these ion sources require that the analyte ions be introduced into this inlet capillary from an extensive ion formation volume, which is successful to only a very limited extent. Only if the analyte ions can successfully be introduced right into the laminar flow of the inlet capillary, a satisfactorily high proportion of these introduced analyte ions will be transported into the vacuum system of the ion spectrometer operating in vacuum.

The spectrometers here can be mass spectrometers or vacuum-operated mobility spectrometers, for example. The inlet capillary usually leads to a first stage of a differential pumping system. In this first stage of the vacuum system, the analyte ions can be captured by a so-called ion funnel, for example, separated from the accompanying gas and introduced into the ion spectrometer via further ion guides and pump stages. The analyte ions are then subjected to the desired type of analysis in the ion spectrometer.

When the term "atmospheric pressure" is used here, it should not be interpreted too narrowly. It is intended to include all pressures above approximately ten kilopascal, even if the term usually refers to ambient pressure.

SUMMARY

The invention provides, for the ionization of the gaseous analyte molecules, a reaction tube which ends in a gastight and smooth transition into the inlet capillary leading to the vacuum system of the ion spectrometer, and is shaped to generate a strongly laminar gas flow that is controlled by the gas flow through the inlet capillary. The gas flow in the reaction tube and also within the entrance region of the inlet capillary is stably laminar. The reaction tube is preferably made from metal, if only to prevent electromagnetic interferences, but can in principle be made from any material if electromagnetic interferences are not present or are otherwise prevented. The reaction tube can be heated in order to prevent the analyte molecules condensing on the inside walls. The gaseous analyte molecules which are to be ionized can originate from any type of source, such as a gas chromatograph, a primary reaction region with gaseous products, a laser ablation chamber, a vaporization device for liquids or solids, or a spray-and-drying device for solvent droplets. The analyte molecules are introduced with a clean transport gas into the front end of the reaction tube. Clean nitrogen, in particular, but also helium or any other gas such as very clean air, for example, can be used as the transport gas.

In one embodiment, approximately one liter of transport gas per minute flows into the vacuum through conventional inlet capillaries with 0.5 millimeter internal diameter and a length of around 15 centimeters.

In another embodiment, the reaction tube can have a length of between eight and thirty centimeters (preferably 20 centimeters) with internal diameters between four and twelve millimeters (preferably eight millimeters).

In still another embodiment, a transition with smooth flow properties into the inlet capillary is achieved by a conical intermediate piece, which maintains the laminarity of the flow in this region so that no boundary turbulences are generated around the entrance of the inlet capillary.

In yet another embodiment, direct ionization of the analyte molecules by single- or multi-photon ionization can be carried out very effectively by directing a laser beam with VUV or UV radiation into the axis of a straight reaction tube. Continuous wave lasers and particularly pulsed lasers can be used for this. The reaction tube has a window for the UV light at its front end to input the laser beam. A flow of clean curtain gas can easily be used to protect the window from contamination. This type of ionization can achieve sensitivities which are more than two orders of magnitude higher than for current APLI.

In another embodiment, chemical ionization of the analyte molecules is brought about by reactant ions, which are also introduced into the reaction tube by means of a transport gas, in addition to the analyte molecules. This can be achieved by using a second feed-in at the front of the reaction tube, or the same feed-in which is also used for the analyte molecules. The two gas flows with analyte molecules and reactant ions should be mixed thoroughly during the introduction. The mixing can be effected by injecting the gas flow with analyte molecules into the gas flow with reactant ions, for example by direct injection from the chromatographic capillary, but also by inserting mixing blades or metal wool. A head-on collision of two gas flows from constricting nozzles can also bring about mixing. If the two gas flows flow laminarly side by side, the reactant ions can also be forced into the gas stream containing analyte molecules by weak electric fields. Highly excited neutral particles can be introduced instead of the reactant ions for the ionization of the analyte molecules, for example highly excited helium, nitrogen or hydrogen atoms. When the term "reactant ions" is used below, it shall also include highly excited neutral particles.

Since the reactant ions are generated outside the reaction tube, the usual methods of generating reactant ions can be employed here, as can those which are not usually used due to their potential to cause electromagnetic interference or their chemically aggressive nature. In short, any ion type of ion source can be used here. The usual electric corona discharges for the generation of reactant ions can be replaced by glow discharges, flowing afterglow discharges, spark discharges or even arc discharges, for example, if they supply suitable reactant ions. Furthermore, it is possible to use inductively coupled plasma, laser pulses on solid material, electrospray ionization, or electron impact (with electrons from beta emitters, for example) to form reactant ions. The reactant ions can also be formed by photoionization, in which case the photons are prevented from reacting directly with the analyte molecules and thus leading to uncontrollable mixed reactions.

The advantage of this type of atmospheric pressure ion source is its stable operation because the actual ionization process is influenced neither by electromagnetic nor gas-dynamic nor chemical interferences. Moreover, the advantage consists in the generation of analyte molecules and reactant ions being strictly separate, and in a low-loss introduction of all analyte ions generated into the inlet capillary.

DETAILED DESCRIPTION

As already described above, the invention proposes to ionize gaseous analyte molecules in a reaction tube which ends in a gastight and smooth transition into the inlet capillary leading to the vacuum system of the ion spectrometer. The strongly laminar gas flow in the reaction tube is produced by the gas flow which arises in the inlet capillary between the pressure in the reaction tube, which is essentially atmospheric pressure, and the vacuum. The terms "with smooth flow properties" or simply "smooth transition" are to be understood here as having no corners or edges which can give rise to turbulences.

Conventional inlet capillaries with 0.5 millimeter inside diameter and a length of around 15 centimeters draw in slightly less than one liter of transport gas per minute between atmospheric pressure and vacuum. This means a reaction tube eight millimeters in diameter has a mean flow velocity of around 0.3 meters per second and a Reynolds number of $Re \approx 200$, i.e. far below the critical Reynolds number $Re_{crit} \approx 2,300$, below which any flow of gas molecules is strictly laminar. There are not even any boundary turbulences, as long as hard and sharp edges are avoided on the inner surface of the reaction tube. In the conical transition, too, there is a strictly laminar flow if the transition is manufactured so as to have smooth flow properties. The conical or horn-shaped intermediate piece to the inlet capillary ensures that no boundary turbulences are created around the entrance of the inlet capillary either, which is not the case with the usually free-standing capillaries. This avoids analyte ion losses, which occur with free-standing inlet capillaries because some of the analyte ions are moved onto the inside surface of the inlet capillary by the boundary turbulences.

The reaction tube can have an internal diameter between four and twelve millimeters and a length of between eight and thirty centimeters, for example. The reaction tube is preferably made from metal, if only to prevent electromagnetic interferences, but can in principle be made from any material if electromagnetic interferences are not present or otherwise prevented. The reaction tube can be heated to temperatures of up to a few hundred degrees Celsius in order to prevent the analyte molecules condensing on the inner walls.

Figure 1:
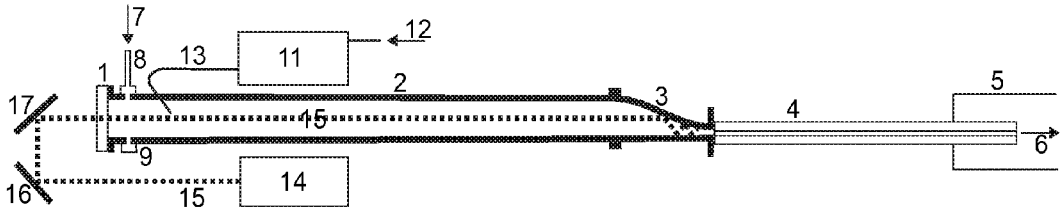
FIG. 1 shows a schematic representation of a very simple embodiment of this invention in the form of a GC-MS coupling with multi-photon ionization of the analyte molecules. The reaction tube (2) is terminated at the front end by a UV-transmitting window (1) and at the far end makes the transition via a sloping conical intermediate piece (3) into the inlet capillary (4), which enters the housing (5) of the vacuum system. The vacuum draws a stream of gas (6) in through the inlet capillary (4), which generates a stably laminar flow in the reaction tube (2). The gas in the reaction chamber, preferably pure nitrogen, originates in large part from the freely aspirated gas flow (7), which flows into the inlet line (8) of a ring duct (9) and then through radial apertures into the reaction tube (2). A gas chromatograph (11), which is itself fed with a gas flow (12), supplies a gas flow containing analyte molecules into the reaction tube (2) via the outlet capillary (13). This gas flow is injected into the laminar flow close to the axis of the reaction tube (2) and thus mixes with the laminar flow. The ionization is performed by pulsed UV radiation (15) from the pulsed laser (14), a Nd—YAG laser with energy quadrupling, for example, via mirrors (16) and (17) into the axis of the reaction tube (2). The laser beam (15) is destroyed at the end in the conical transition piece by multiple reflections. The ionization is very effective because of the long interaction path of the laser beam (15). The sensitivity achieved is over a hundred times better than conventional APLI.

FIG. 1 is a schematic representation of a particularly simple embodiment of the invention, in the form of an ion source which is designed for multi-photon ionization of aromatic substances from a gas chromatograph. The ion source couples the gas chromatograph (11) to a mass spectrometer (GC-MS). At the far end, the reaction tube (2) has a horn-shaped intermediate piece (3) with smooth flow properties. This horn (3) forms the transition into the inlet capillary (4) which leads into the housing (5) of the vacuum system. A gas stream (6) is drawn in through the inlet capillary by the vacuum of the first pump stage of the mass spectrometer, and this gas flow creates a stably laminar flow in the reaction tube (2). The gas flowing out of the reaction chamber is replenished by the gas flow (7), which preferably consists of pure nitrogen. This gas flow (7) leads via the inlet line (8) into a ring duct (9), from which the gas flows through radial apertures into the reaction tube (2).

The intermediate piece (3) does not need to be horn-shaped in the way it is depicted in FIG. 1. In the simplest case, a straight or also slightly sloping cone is sufficient to achieve a transition with smooth flow properties.

The analyte molecules which are to be ionized are supplied by the gas chromatograph (11), which is primarily operated with a gas flow (12) that is considerably smaller than the gas stream flowing out through the inlet capillary and into the vacuum. The analyte molecules are injected through the heated outlet capillary (13) of the gas chromatograph (11) into the laminar gas flow in the reaction tube (2), close to the axis of the reaction tube (2) so that the analyte molecules can diffuse into the laminar flow. It is advantageous if they mainly stay in the center of the laminar flow. It is assumed here that the reaction tube (2) has an inside diameter of eight millimeters and a length of twenty centimeters. The average flow velocity is then approximately 0.3 meters per second; the flow velocity on the axis around 0.6 meters per second. The minimum dwell time of an analyte molecule which is guided near the axis is around 300 milliseconds.

The ionization is brought about by directing pulsed UV radiation (15) from a 200 Hz Nd—YAG pulsed laser (14) with energy quadrupling, for example, via the mirrors (16) and (17), through the UV-transmitting window (1), and into the axis of the reaction tube (2). With aromatic substances this allows multi-photon ionization with a large reaction cross-section. The laser beam is adjusted to a diameter of around one millimeter. This means that around 60 pulses of laser light pass through the reaction tube (2) during the minimum dwell time of an analyte molecule. This results in a high ionization probability for all aromatic analyte molecules. The laser beam (15) is destroyed at the end in the conical transition piece by multiple reflections; an absorbing inside surface in the conical transition piece is advantageous.

The impact of the beam of laser light on the inside surface of the conical intermediate piece (3) generates photoelectrons, which remain for a while as a diffuse cloud in the conical intermediate piece (3). If these electrons prove to be interfering (by neutralizing analyte ions, for example) they can quickly be removed each time. To this end, the intermediate piece (3) can be constructed from two halves, for example, which are assembled so as to be insulated from one another. The electrons can be extracted with a voltage of around 20 volts, which is triggered by the laser pulses and applied to the halves for around 10 microseconds. Constructing the conical intermediate piece from halves is also advantageous for manufacturing reasons.

The ionization is very effective because of the long interaction path of the laser beam (15) with the analyte molecules. The sensitivity achieved is more than one hundred times higher than with conventional APLI.

Different lasers can be used to ionize different substances. Multi-photon ionizations require pulsed UV lasers with high energy density.

The gaseous analyte molecules which are to be ionized do not have to be supplied by a gas chromatograph; they can originate from any type of source for gaseous products. It is thus possible to investigate products produced in primary reaction chambers. The analyte molecules can originate from vaporization devices for liquids or solids, simply from heated containers, for example. It is also possible to vaporize solid samples on sample supports by pulsed laser beams. The analyte molecules can originate from drying droplets of a thermospray device for liquids. The person skilled in the art is familiar with many ways of generating gaseous analyte molecules. The analyte molecules can be injected in a clean transport gas through a side inlet into the front end of the reaction tube. Clean nitrogen, in particular, but also helium or any other gas such as very clean air, for example, can be used as the transport gas.

Moreover, the analyte molecules do not have to be ionized by photoionization; this can also be effected by chemical ionization. This type of ionization is also known to the person skilled in the art and is not described further here. Chemical ionization of the analyte molecules requires reactant ions, which must be produced especially for this purpose and introduced into the reaction tube by a transport gas. A second inlet at the front of the reaction tube can be used for this, as can the same inlet as is used for the analyte molecules. When introducing the reactant ions, care must be taken to thoroughly mix the gas flows containing analyte molecules and reactant ions, or at least to mix analyte molecules and reactant ions.

Since the reactant ions are produced outside the reaction tube, the usual methods of generating reactant ions can be used here, as can those which are not usually used due to their potential to cause electromagnetic interference or to their chemically or physically aggressive nature. The usual electric corona discharges for the generation of reactant ions can be used here, but also glow discharges, flowing afterglow discharges, spark discharges or even arc discharges, for example, if they supply suitable reactant ions. Furthermore, it is possible to use inductively coupled plasma, ionizing laser pulse ablation or electron impact (with electrons from beta emitters, for example). The reactant ions can also be formed by photoionization, in which case the invention prevents the photons from already reacting directly with the analyte molecules and thus leading to uncontrollable mixed reactions.

Figure 2:
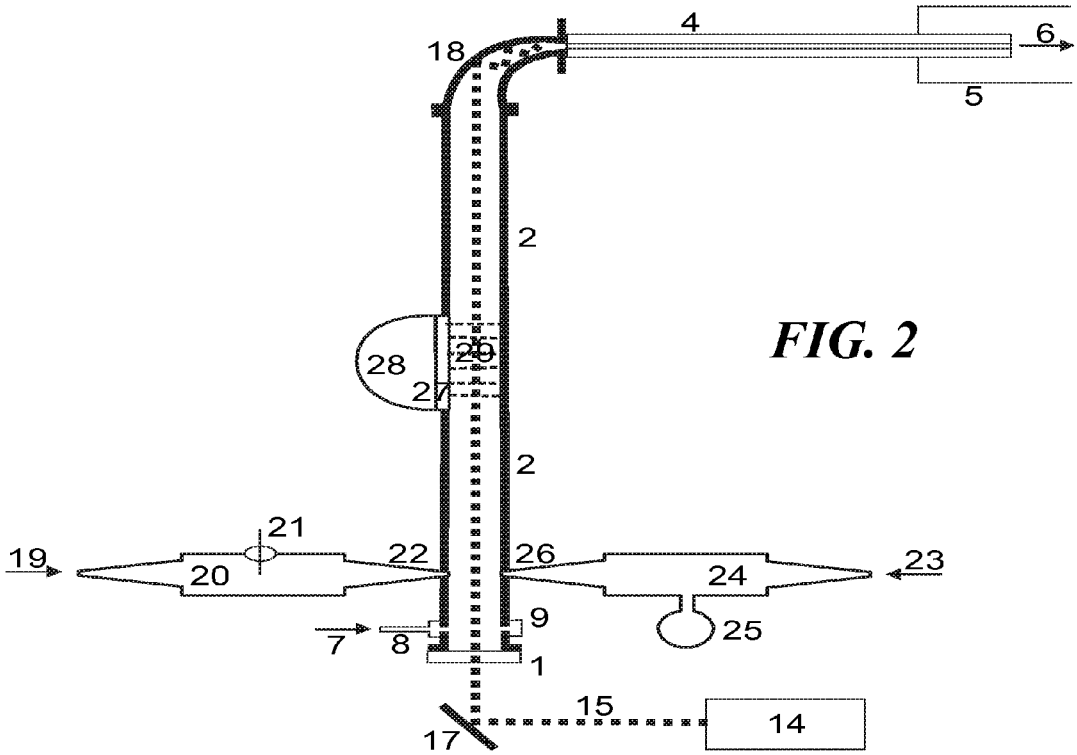
FIG. 2 depicts a schematic representation of a further arrangement of the reaction tube (2), where the reaction tube is connected to the inlet capillary (4) via a curved cone (18). The curved cone acts like an exponential horn for the beam of UV laser light (15) for the complete absorption of the radiation. The laminar flow follows the curve of the cone (18) without disturbances because it is extraordinarily stable at these flow velocities and diameters. The gas inflow (7) here is greatly restricted and only supplies a little curtain gas to keep the UV window (1) clean. The two main fractions (19) and (23) of the incoming gas pass through the chamber (20) to produce the reactant ions by a corona discharge at the pin (21), on the one hand, and through the chamber (24) to mix analyte molecules, which are produced here in the vaporization device (25), with the transport gas (23), on the other hand. The two gas flows (19) and (23) are accelerated by nozzles as they are introduced into the reaction tube (2) and collide with each other head-on in the reaction tube, which causes them to mix to a high degree.—Instead, the UV radiation (15) for multi-photon ionization can be replaced with VUV radiation (29) from a VUV light source (28) for single-photon ionization. This VUV radiation in introduced perpendicularly into the reaction tube (2) through a lithium fluoride window (27) accurately inserted into the wall of the reaction tube (2) due to its short range in nitrogen at atmospheric pressure.

One example for such an ion source, which can also operate with chemical ionization, is depicted in FIG. 2. In this example, the reaction tube (2) is connected to the inlet capillary (4) in a slightly different way to FIG. 1, namely via a curved horn (18). This curved horn has two features: it acts like an exponential horn to completely absorb the radiation of the beam of laser light (15), and it also allows the ion source to have a more compact configuration. The laminar flow follows the curve of the horn (18) without disturbances, because it is extraordinarily stable at these flow velocities and diameters. In order to extract the electrons, this horn can also be constructed from two halves, which are assembled so as to be insulated from each other and which can be supplied with short pulses of a DC voltage. Here, too, the design using halves is advantageous in terms of manufacturing, especially because the inside surfaces should be well smoothed and polished.

The gas inflow (7) here is greatly restricted and supplies only a small amount of curtain gas to keep the UV window (1) clean. The window is only used if direct photoionization of the analyte substances by laser beams is desired.

Instead of the UV laser radiation (15) for multi-photon ionization, it is also possible to use VUV radiation (29), here from a VUV light source (28), for single-photon ionization. It is expedient to direct this VUV radiation transversely into the reaction tube (2) because it has only a very short range in nitrogen at atmospheric pressure. It is directed in through a lithium fluoride window (27) which is accurately inserted into the wall of the reaction tube (2).

The gas flow (19), which amounts to about half of the total gas flow, consists of slightly moist nitrogen and flows through the chamber (20) to generate the reactant ions by a corona discharge at the sharpened pin (21). The other half (23) of the gas flow streams through the chamber (24) and is mixed with analyte molecules, which are produced here in a vaporization device (25). The two gas flows from the chambers (20) and (24) are accelerated as they are introduced into the reaction tube (2) by nozzles (22) and (26) and collide head-on in the reaction tube, causing them to be homogeneously mixed to a large extent by turbulences ("gas-dynamic mixing").

It should be emphasized here that the methods mentioned for the generation of the gas molecules and reactant ions are only examples. Many other methods are known to the specialist in the field. In addition to these known methods, this invention also makes it possible to use those methods which could not be used until now due to their electromagnetic or chemical interference potential.

Figure 3:
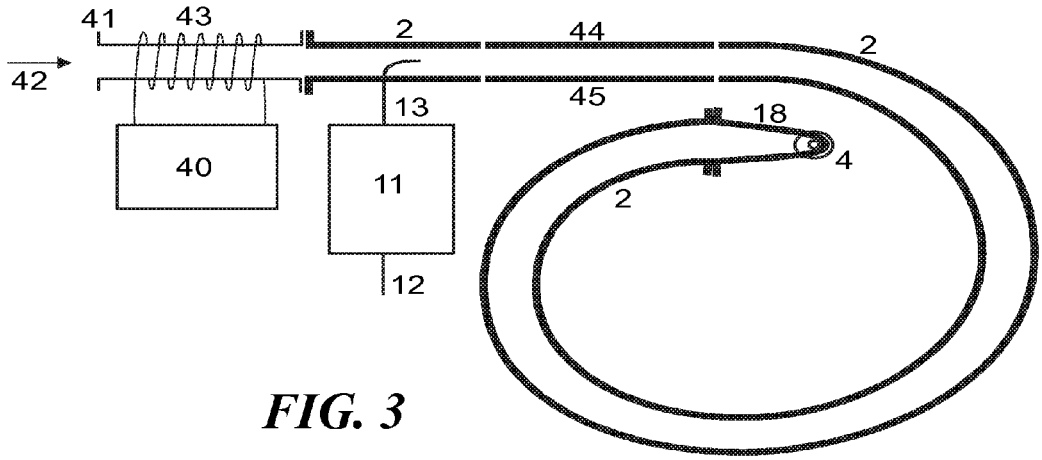
FIG. 3 exhibits schematically a GC-MS coupling with chemical ionization of the analyte molecules injected into the reaction tube (2) from the gas chromatograph (11) via the exit capillary (13). Since no photoionization is to be used here, the reaction tube (2) can be curved. It leads via a likewise curved cone (18) into the inlet capillary (4), which here is arranged perpendicular to the plane of the drawing. The reactant ions here are produced in a glass tube (41) from moist nitrogen (42) by a plasma which is inductively generated with the aid of the coil (43), which is supplied with RF voltages by the transmitter (40). To mix the reactant ions with the analyte molecules in the reaction tube (2), two opposing electrodes (44) and (45) are inserted gastight into the wall of the reaction tube (2), and a low alternating voltage generates an alternating field on these electrodes, which forces the reactant ions, due to their high mobility, several times through the flow string with the analyte molecules.

FIG. 3 thus shows the generation of the reactant ions by an inductively coupled plasma (ICP). Until now, such an inductively coupled plasma has been used in mass spectrometry only where analyte substances were to be decomposed into their atoms for an elemental analysis. However, this method also produces unusual reactant ions, for example argon hydride ions, i.e. protonated argon. However, plasma ion sources of this type do not have to be used with these unusual reactant ions, it is also possible to use, for example, water complex ions, which are produced in extremely large quantities by ICP, to chemically ionize the analyte molecules.

FIG. 3 also shows that the reaction tube (2) for the ionization of the analyte molecules does not have to be straight; the highly stable laminar flow means it can also be curved if no direct photoionization is to be used. In FIG. 3 the analyte molecules again originate from a gas chromatograph (11); here, too, they are injected centrally into the laminar gas flow in the reaction tube (2), through the outlet capillary (13) of the gas chromatograph (11). The gas flow from the gas chromatograph very quickly forms a laminar flow string, which guides the analyte molecules and mixes only slightly with the main gas flow. But if there is a long path through the reaction tube (2), enough reactant ions diffuse from the main gas flow into this flow string with analyte molecules to ionize the analyte molecules with a high yield.

If the reaction path is not long enough for a sufficiently strong diffusion of the reactant ions, their mobility allows them to be guided electrically through the flow string with analyte molecules, too. In FIG. 3, two electrodes (44) and (45) facing each other have been inserted, gastight but insulated, into the wall of the reaction tube (2) for this purpose. The two phases of a low alternating voltage on these electrodes generate a weak alternating electric field which forces the reactant ions through the flow string with the analyte molecules several times ("electric mixing").

Figure 4:
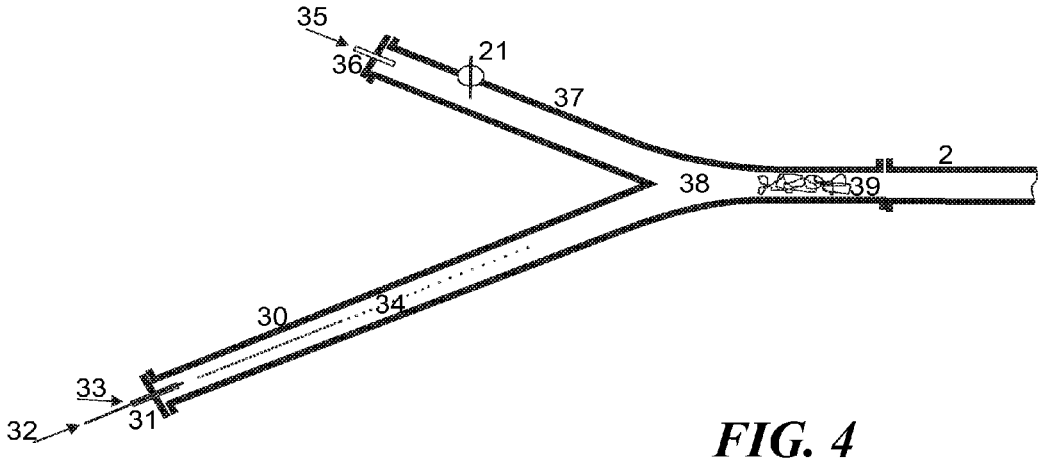
FIG. 4 shows how the transport gas flows with reactant gas ions and with analyte molecules can be brought together in a Y-connection (38) and mixed with the aid of loose metal wool (39) before they enter the reaction tube (2). In this example, the analyte molecules originate from a micro-thermospray device (31) in which a solvent flow (32) with dissolved analyte molecules is nebulized by a hot spray gas (33) to form a jet of droplets (34). The droplets dry gradually in the drying tube (30) to leave behind gaseous analyte molecules. The flow of hot spray gas amounts to around 500 milliliters per minute and thus supplies around half of the gas flow through the reaction tube (2) into the inlet capillary. The other half is introduced as a moist nitrogen flow (35) through an inlet capillary (36) into the tube (37) to a corona discharge, which is generated with the aid of the corona pin (21).

If it is necessary to bring together two gas flows with reactant ions and analyte molecules from separate chambers, mixing can be achieved by gas-dynamic head-on collision of two gas flows from constricting nozzles as in FIG. 2, by electric mixing similar to that in FIG. 3, or by inserting mixing blades or metal wool. FIG. 4 shows this type of "mechanical mixing" by metal wool, in which reactant ions and analyte molecules are brought together from two different tubes (30) and (37) in a Y-connection (38). Since the laminar flows in the reaction tube (2) would flow in parallel, separate from one another to a large extent, they are mixed here by the steel wool (39); the losses of reactant ions are low and can be easily accepted. It is also possible here to replace the steel wool with suitably shaped mixing blades, at whose sharp edges the gases are swirled together. As in FIG. 2, the reactant ions here are generated from slightly moist nitrogen (35) by a corona discharge on a sharpened pin (21). Even for parallel laminar gas flows with analyte molecules, on the one hand, and reactant ions, on the other, the reactant ions can be drawn into the gas flow with analyte molecules by a weak electric field generated by one or more wall electrodes.

FIG. 4 also schematically depicts a further example of the generation of gaseous analyte molecules, a method of generation which is particularly suited for analyte substances that cannot be thermally vaporized without being decomposed. This is miniaturized thermospray. A small flow of liquid (32) with dissolved analyte molecules is nebulized into a fine jet of droplets (24) by a focused jet of strongly heated spray gas (33), which is blown in concentrically. The droplets completely vaporize in the heated chamber (30) on their way to the Y-connection (38) and leave behind free, gaseous analyte molecules.

These examples have been given here to illustrate that many methods of generating gas flows with gaseous analyte molecules or with reactant ions can be used for the invention. Those skilled in the art are aware of further methods.

Instead of introducing reactant ions, it is also possible to introduce highly excited neutral particles to ionize the analyte molecules, for example highly excited helium, nitrogen or hydrogen atoms. The mechanisms of this type of ionization have not yet been fully understood. Where the term "reactant ions" has been used, it shall include the highly excited neutral particles. These can fulfill all the functions of the reactant ions, the only exception being electric mixing.

The advantages of the atmospheric pressure ion sources based on this invention are manifold. On the one hand, they offer a stable method of operation, because the actual ionization process cannot be affected by electromagnetic nor gas-dynamic nor chemical interferences. For chemical ionization they offer a strict separation of the generation of analyte molecules and reactant ions. For direct photoionization by laser beam they provide an unusually high yield of analyte ions. And finally, all analyte ions formed in the reaction tube according to the invention are guided into the vacuum of the ion analyzer with a high transfer rate.

While the invention has been shown and described with reference to a number of embodiments thereof, it will be recognized by those skilled in the art that various changes in form and detail may be made herein without departing from the spirit and scope of the invention as defined by the appended claims.

What is claimed is:

1. An ion source that ionizes analyte molecules at atmospheric pressure and supplies resulting analyte ions through an inlet capillary to an ion spectrometer in a vacuum, the ion source comprising:

a reaction tube that receives the analyte molecules and is shaped to generate a laminar gas flow at substantially atmospheric pressure along its length, wherein the reaction tube is terminated at one end by a UV-transmitting window;

an ionization mechanism that ionizes the analyte molecules within the reaction tube, wherein the ionization mechanism comprises a UV laser whose light is directed through the window along an axis of the reaction tube; and a gastight connection piece with gas flow properties that do not generate turbulence connected between the reaction tube and the inlet capillary.

2. The ion source of claim 1, wherein the reaction tube is connected to one of a gas chromatograph, a primary reaction chamber, a vaporization device, and a spray-and-dry device for droplets.

3. The ion source of claim 1, comprising a reactant ion source that generates reactant ions outside the reaction tube.

4. The ion source of claim 3, wherein the reaction tube has apertures for the introduction of the analyte molecules and the reactant ions.

5. The ion source of claim 3, wherein the reactant ion source comprises one of an electric discharge device, a device for generating an inductively coupled plasma, a laser pulse ablation device, an electron impact device, and a photoionization device.

6. The ion source of claim 3, comprising one of a mechanical device, a gas-dynamic device and an electrical mixing device for mixing the reactant ions and the analyte molecules.

7. The ion source of claim 6, wherein the reaction tube has a wall that comprises an insulated electrode, which can be supplied with a voltage in order to mix the reactant ions and the analyte molecules.

8. The ion source of claim 1, wherein the gastight connection piece is conical.

9. The ion source of claim 1, wherein the connection piece is constructed from two halves which are assembled so as to be insulated from one another and to which an extraction voltage can be applied for removing photoelectrons.

10. The ion source of claim 1, wherein the UV laser is one of a continuous wave laser and a pulsed laser.

11. An ion source that ionizes analyte molecules at atmospheric pressure and supplies resulting analyte ions through an inlet capillary to an ion spectrometer in a vacuum, the ion source comprising:

a reaction tube that receives the analyte molecules and is shaped to generate a laminar gas flow at substantially atmospheric pressure along its length;

an ionization mechanism that ionizes the analyte molecules within the reaction tube; and a gastight connection piece with gas flow properties that do not generate turbulence connected between the reaction tube and the inlet capillary;

wherein two chambers are laterally arranged at the reaction tube such that one gas flow containing one of reactant ions and highly excited neutral particles from one chamber and another gas flow containing analyte molecules from the other chamber are introduced into the reaction tube and collide with each other head-on, which causes them to mix.

12. The ion source of claim 11, wherein the highly excited neutral particles comprise one of atomic helium, nitrogen, and hydrogen.

13. The ion source of claim 11, wherein the gastight connection piece has the shape of a curved cone.

14. An ion source that ionizes analyte molecules at atmospheric pressure and supplies resulting analyte ions through an inlet capillary to an ion spectrometer in a vacuum, the ion source comprising:

a reaction tube that receives the analyte molecules and is shaped to generate a laminar gas flow at substantially atmospheric pressure along its length, wherein the reaction tube at one end is attached to a Y-connection, one arm of the Y-connection delivering a gas flow with one of reactant ions and highly excited neutral particles, and the other arm of the Y-connection delivering a gas flow with the analyte molecules, the Y-connection further having a mechanical mixing device in a region of confluence of the two gas flows;

an ionization mechanism that ionizes the analyte molecules within the reaction tube; and a gastight connection piece with gas flow properties that do not generate turbulence connected between the reaction tube and the inlet capillary.

15. The ion source of claim 14, wherein the mechanical mixing device comprises one of metal wool and mixing blades.

16. An ion source that ionizes analyte molecules at atmospheric pressure and supplies resulting analyte ions through an inlet capillary to an ion spectrometer in a vacuum, the ion source comprising:

a reaction tube that receives the analyte molecules and is shaped to generate a laminar gas flow at substantially atmospheric pressure along its length;

an ionization mechanism that ionizes the analyte molecules within the reaction tube; and a gastight connection piece with gas flow properties that do not generate turbulence connected between the reaction tube and the inlet capillary;

wherein two opposing electrodes are inserted gastight into the wall of the reaction tube, the two opposing electrodes being supplied with low alternating voltages so that they generate an alternating field which causes mixing of reactant ions and analyte molecules.

* * * * *